United States Patent [19]

Racunas et al.

[11] 3,975,149

[45] Aug. 17, 1976

[54] RING FURNACE

[75] Inventors: Bernard J. Racunas, New Kensington; Raymond Kastelic, Lower Burrell, both of Pa.

[73] Assignee: Aluminum Company of America, Pittsburgh, Pa.

[22] Filed: Apr. 23, 1975

[21] Appl. No.: 570,730

[52] U.S. Cl. ..... 432/209; 432/212; 432/213

[51] Int. Cl.[2] ..... F27B 5/14; F27B 13/12

[58] Field of Search ..... 432/212, 213, 192, 209

[56] References Cited

UNITED STATES PATENTS

| | | | |
|---|---|---|---|
| 659,175 | 10/1900 | Meikleham | 432/212 |
| 1,833,088 | 11/1931 | Mohring | 432/213 |
| 2,137,693 | 11/1938 | Lundt | 432/209 |
| 3,448,971 | 6/1969 | Renkey | 432/212 X |

*Primary Examiner*—John J. Camby

*Attorney, Agent, or Firm*—Daniel A. Sullivan, Jr.

[57] ABSTRACT

A ring furnace including pits bounded laterally by side wall flues, the side wall flues being connected in series by means for conducting gases between the side wall flues of the pits, so that heat in previously fired side wall flues can preheat air for combustion in a fired side wall flue and exhaust gases from the fired side wall flue can give up heat to articles in pits bounded by yet-to-be-fired side wall flues, wherein the improvement includes a Y-baffle inverted and centered in at least one of the side wall flues.

2 Claims, 3 Drawing Figures

RING FURNACE

BACKGROUND OF THE INVENTION

The present invention relates to ring furnaces and more particularly to an improved baffle in the side wall flues thereof for producing improved, for example, carbonaceous anodes for use in producing aluminum metal by electrolysis of alumina dissolved in a molten salt electrolyte.

As explained by J. Z. Nelson at the AIME Annual Meeting, Washington, D.C., Feb. 18, 1969, A carbon baking ring furnace is made up of a number of pits for the anodes, arranged in rows or "sections" in two halves of a suitable building. The number of pits per section ranges from six to nine, and the number of sections per furnace varies from 60 to 96. Pit size is chosen to suit the anodes to be baked — pits are about three feet wide, nine to ten feet long, and nine to ten feet deep. Refractory flues make up the side walls of each pit, and refractory headwalls form the ends of the pits. The flues are connected in series. Firing and waste gas equipment is movable, so that four to six fires can move around the furnace in procession.

Anodes are packed in the furnace pits in layers, either upright or on end, with sized coke packing material for support as the anodes soften during baking; and with a top blanket of coke to insulate and seal the pit. The packing coke may contain volatiles — these and volatiles from the anode binder are burned inside the flues (operating at reduced pressure), contributing to fuel input. Cathode blocks may also be baked in ring furnace pits, and cokes and anthracite coals may be calcined.

From 13 to 18 sections in a series are needed for the operation of one "fire" in a ring furnace. A "fire" is a series of burners, arranged with one to each flue in a section. Considering one such fire in a ring furnace, the sections involved would be:

A. One to three sections will have cooled, and are being unpacked. Pit temperatures will be 200° – 300°C.

B. Five to seven sections of baked anodes will be cooling. Combustion air for the fire will be drawn through the flues of some or all of these sections. depending on draft capacity. Pit temperatures will range from 400° to 1150°C. Air to the baking section will be 800° – 1100°C.

C. One section will be baking. During the firing time of 40 to 60 hours, pit center temperatures in that section will be raised from 800° – 900°C. to 1100° – 1200°C.

D. Two to four sections of green anodes will be preheated by the waste gas passing through their flues. Pit temperatures thus range from "cold" up to 800° – 900°C.; while the waste gas cools from 1300° – 1400°C. down to 300° – 400°C.

E. One to three sections of green anodes will be waiting their turn at preheating as the fire moves toward them.

F. One to three sections of pits will be empty, for any refractory maintenance and for reloading.

For extensive, detailed illustrations of the design of ring furnaces, reference is made to U.S. Pat. Nos. 1,330,164, 1,330,175, and 1,351,281.

These patents have their individual idiosyncrasies, but they all operate essentially as described by J. Z. Nelson.

With respect to 1,330,164, a peculiarity of that design is that the flame first extends out under a cover and over the pits. The present inventors prefer to completely insulate the tops of the pits and to fire directly into the flues of the pit side walls. Also, it is the preferred practice of the present inventors not to run the air or combustion gases underneath the pits, but rather to let them pass directly from side wall flue to side wall flue.

In 1,330,175, it will be seen that the art had already begun to abandon the technique of initially firing underneath a cover and over the pits. Thus, in 1,330,175, firing is directly into the flues in the pit side walls. However, here, too, there is a difference between what was done earlier and the presently preferred practice of the inventors, in that the firing is effected with the flame direction horizontal into the upper part of the flues. In contrast, presently preferred practice is to direct the fuel downwardly into the flue being fired.

In 1,351,281, we have an example of the art's using the downwardly directed introduction of the fuel into the flue in the manner preferred by the inventors.

In the TMS PAPER SELECTION Paper No. A69-26, of the Metallurgical Society of AIME, entitled "Operation of Ring Type Anode Baking Furnaces - Methods of Improving Baked Anode Quality" by R. C. Abrahamson, W. F. Barrier, and A. O. Pinner, which was presented at the TMS-AIME Annual Meeting, February 17–20, 1969, at Washington, D.C., it is explained that a desired goal in the operation of ring furnaces is the maintaining of the temperature within the pits as uniform as possible.

SUMMARY OF THE INVENTION

It is an object of the present invention to provide an improved baffle in the side wall flues of ring furnaces for the purpose of obtaining more uniform temperature distributions in the pits which the side wall flues adjoin.

This as well as other objects which will become apparent in the discussion which follows are achieved, according to the present invention, by providing a ring furnace including pits bounded laterally by side wall flues, the side wall flues being connected in series by means for conducting gases between the side wall flues of the pits, so that heat in previously fired side wall flues can preheat air for combustion in a fired side wall flue and exhaust gases from the fired side wall flue can give up heat to articles in pits bounded by yet-to-be-fired side wall flues, wherein the improvement includes a Y-baffle inverted and centered in at least one of the side wall flues.

DETAILED DESCRIPTION

Figure 1:
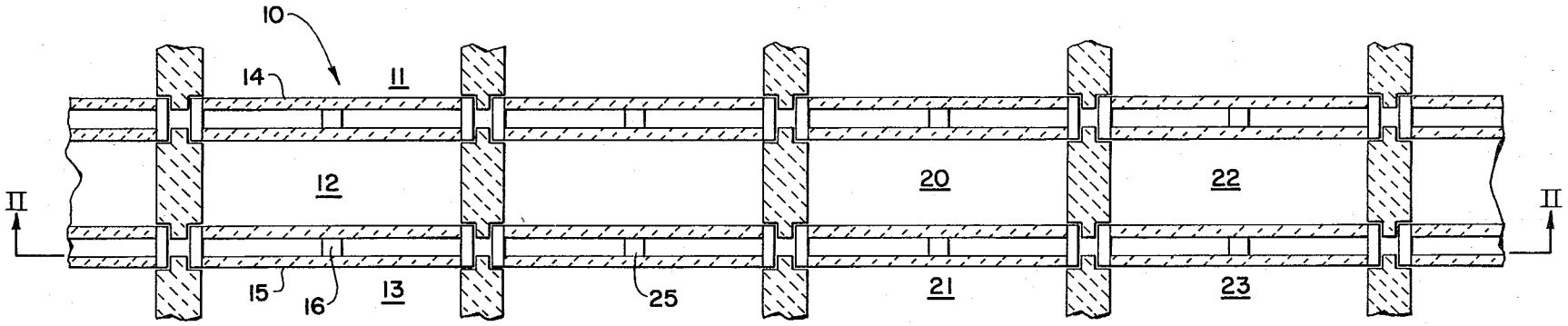
FIG. 1 is a plan, cross sectional view of a portion of a prior art ring furnace, the view being taken on the plane I—I of FIG. 2.
Figure 2:
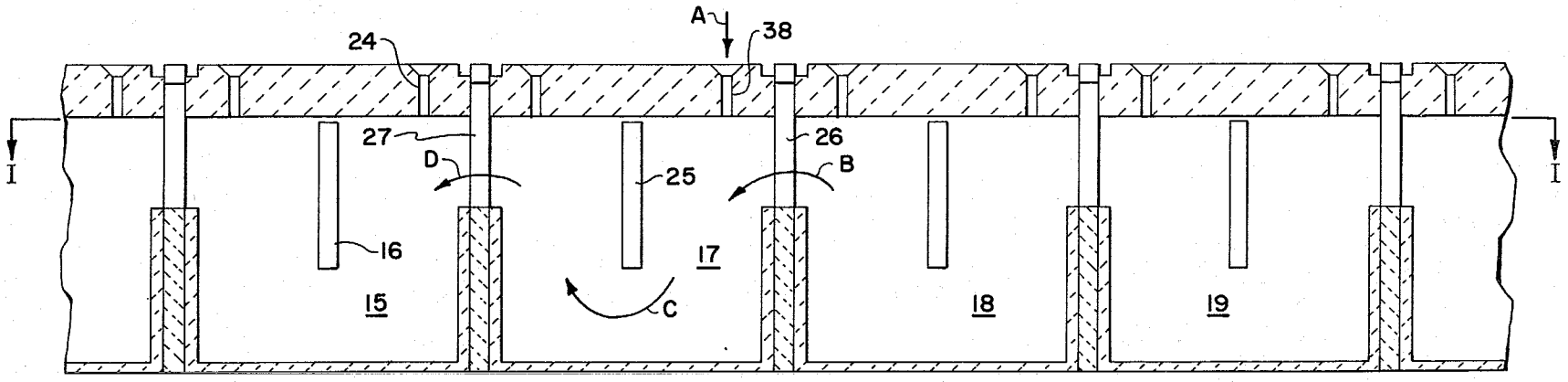
FIG. 2 is a cross sectional view taken on the plane II—II of FIG. 1.

Referring firstly to FIGS. 1 and 2, these illustrate a prior art ring furnace. In FIG. 1, the portions of six sections of a ring furnace are shown. For section 10, for instance, the drawing shows all of pit 12 and parts of pits 11 and 13. As noted by Nelson, supra, there may be six to nine pits to a section. The exemplary upright side wall flues 14 and 15 bound pit 12 laterally. Within flue 15 is situated a baffle 16 whose function will be explained below.

At the particular point in time at which this illustration in FIGS. 1 and 2 is made, let it be assumed arbitrarily that fuel is being introduced into flue 17 through opening 38 downwardly in the direction of arrow A, at that end of the flue at which air for combustion of the fuel is flowing into the flue in the manner indicated by arrow B. This air has already been preheated in flues 18, 19, etc. by heat in these flues supplied essentially from hot, but cooling, anodes in pits 20, 21 and 22, 23. The flame in flue 17 descends in its right half and reaches upwards in its left half as indicated by arrow C. Hot products of combustion move along the line of arrow D into flue 15 and act to bring green (i.e. as yet unbaked, or only partially baked) anodes in pits 12, etc. further upwards in temperature, toward the temperature that they will eventually reach, when firing from opening 38 is ceased and firing from opening 24 is begun. Baffles, for instance baffles 16 and 25, are situated in each flue for the purpose of preventing the gas flow from short circuiting between, for example, the inlet and outlet passages 26 and 27 at the opposed upper corner regions of flue 17.

Figure 3:
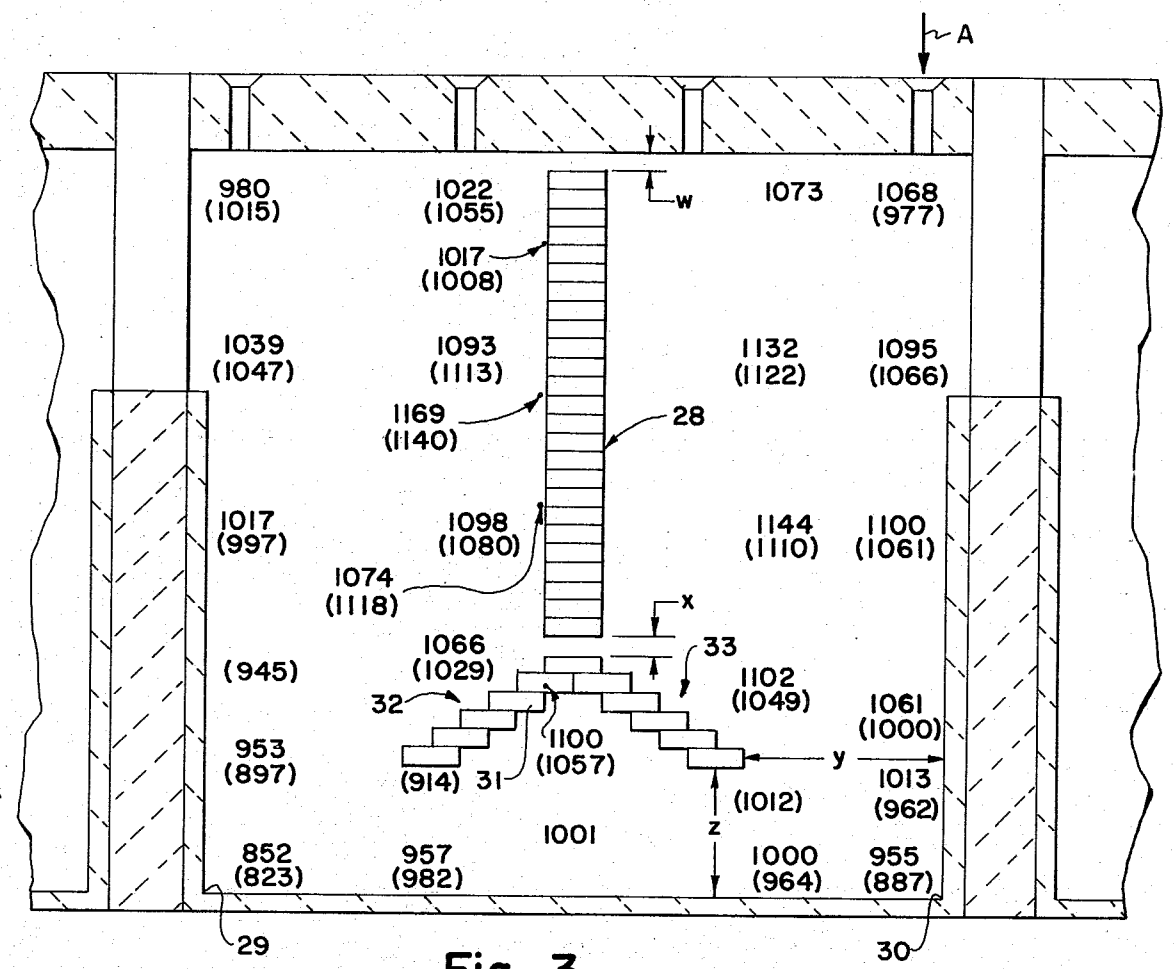
FIG. 3 is a view, as in approximately one-fourth of FIG. 1, of a ring furnace flue incorporating the improvement of the present invention.

In accordance with the present invention, baffle 25, 16, or one of those unnumbered, is replaced by a similarly centered, inverted Y-baffle 28, as illustrated in FIG. 3. At the larger scale of FIG. 3, as compared with FIG. 2, it has been possible to indicate in FIG. 3 that baffles, in general, are made of bricks. Isolated tie bricks (not shown) generally also extend across the width of flues and into the flue walls at appropriate intervals to lend added strength to the flue construction. Additionally, it is the general practice to make the bricks of the baffles long enough that they extend into the walls of the flues, in order to support the baffles, and, thus, cross hatching on the individual bricks of baffle 28 has been omitted only for the purpose of simplifying the drawings.

Preferably, all of the baffles shown in FIGS. 1 and 2 are replaced by the inverted Y-baffle of the present invention. It has been discovered that this simple change in the baffle form leads to a more uniform temperature in the pits. At the same time, there is no significant increase in the pressure drop experienced by the gases as they flow through a flue.

In FIG. 3, there are illustrated, in °C, the temperatures obtained in a pit bounded on both sides by fired side wall flues each containing an inverted Y-baffle 28. The locations of the temperature values in the figure correspond to the locations on the center line in the adjoining pit where those temperatures exist. Those temperatures in parentheses are for a baffle 25, i.e. for conventional practice, while those figures without parentheses are for the inverted Y-baffle of the present invention. In this illustrative example, the flue dimensions in the figure were approximately ten feet by ten feet, while the flue width (i.e. as measured into and out of the plane of FIG. 3) was approximately six and three-fourths inches. Dimension W was 3-inches, dimension X was 2-inches, dimension Y was 27-inches and dimension Z was 21-inches. Thus, this FIG. 3 is approximately to scale. In both the measurements with the standard baffle 25 and those with the Y-baffle, the same fuel input was used.

The mean pit temperature in these comparative tests was 1030°C for the standard baffle 25 and 1045°C for the inverted Y-baffle. For the Y-baffle, the standard deviation from the mean temperature was 68°C, while for the standard baffle the corresponding standard deviation was 82°C; these standard deviations, in particular, show that a more uniform temperature is being obtained through the use of the inverted Y-baffle. Also evident from this data is the face that, because greater uniformity in temperature has been obtained, it is safe to operate at a higher mean pit temperature, without there being worry that high deviations above the mean pit temperature will result in refractory failure somewhere within the flue.

We are not as yet sure that we have arrived at the optimum inverted Y-baffle. For instance, we believe it may be possible to vary dimensions W, X, Y, and Z and obtain yet further improvements in temperature uniformity. Thus, dimensions Y and Z may be made smaller for the purpose of bringing the legs 32 and 33 of the inverted Y closer to the corners 29 and 30 to increase the corner temperature further. Also, the dimension X at the apex can be made zero, i.e. there is then no gap in the bricks at the apex. Another possibility is to make the design somewhat unsymmetric, for example, by removing just brick 31 when dimension X is zero. It will be appreciated that the purpose of these contemplated changes is to work toward increasing the temperature at those areas which have remained still relatively cool in the temperature map superimposed on FIG. 3.

It will be understood that the above description of the present invention is susceptible to various modifications, changes, and adaptations and the same are intended to be comprehended within the meaning and range of equivalents of the appended claims.

What is claimed is:

1. A ring furnace including pits bounded laterally by upright side wall flues, the side wall flues being connected in series by means for conducting gases from an outlet upper corner region of one flue to an inlet upper corner region of the next flue in the series, the outlet upper corner region of any given flue being opposite to its inlet upper corner region, so that heat in previously fired side wall flues can preheat air for combustion in a fired side wall flue and exhaust gases from the fired side wall flue can give up heat to articles in pits bounded by yet-to-be-fired side wall flues, wherein the improvement comprises means for forming a Y-shaped baffle in at least one of said side wall flues, the Y being inverted and centered in the flue.

2. A ring furnace as claimed in claim 1, the type of ring furnace wherein said improvement is included being further of the type wherein a fuel introduction means in a fired side wall flue directs the fuel downwardly into the flue, at the preheated-air-introduction end of the flue.

* * * * *